US006789323B2

(12) United States Patent
Moizis

(10) Patent No.: US 6,789,323 B2
(45) Date of Patent: Sep. 14, 2004

(54) FOLDING TOOL

(75) Inventor: Stan Moizis, Delta (CA)

(73) Assignee: Mentor Group LLC, Oregon City, OR (US)

( * ) Notice: Subject to any disclaimer, the term of this patent is extended or adjusted under 35 U.S.C. 154(b) by 0 days.

(21) Appl. No.: 10/655,795

(22) Filed: Sep. 5, 2003

(65) Prior Publication Data

US 2004/0045171 A1 Mar. 11, 2004

Related U.S. Application Data

(63) Continuation of application No. 10/043,480, filed on Jan. 10, 2002, now Pat. No. 6,732,436.

(51) Int. Cl.[7] ..... B26B 1/02
(52) U.S. Cl. ..... 30/155; 30/159; 30/160
(58) Field of Search ..... 30/160, 155, 158, 30/337, 331, 161, 159; 7/900

(56) References Cited

U.S. PATENT DOCUMENTS

| | | | | | |
|---|---|---|---|---|---|
| 118,675 | A | | 9/1871 | Beckham | |
| 226,910 | A | | 4/1880 | Friebertshauser | |
| 1,969,100 | A | | 8/1934 | Segal | |
| 4,918,820 | A | * | 4/1990 | Korb et al. | 30/161 |
| 5,029,354 | A | * | 7/1991 | Boyd et al. | 7/118 |
| D321,820 | S | | 11/1991 | Russell | |
| 5,331,741 | A | * | 7/1994 | Taylor, Jr. | 30/158 |
| 5,502,895 | A | | 4/1996 | Lemaire | |
| 5,511,310 | A | | 4/1996 | Sessions et al. | |
| 5,537,750 | A | | 7/1996 | Seber et al. | |
| 5,546,662 | A | | 8/1996 | Seber et al. | |
| 5,621,973 | A | | 4/1997 | Seber et al. | |
| 5,685,079 | A | | 11/1997 | Brothers et al. | |
| 5,692,304 | A | | 12/1997 | Campbell | |
| 5,802,722 | A | | 9/1998 | Maxey et al. | |
| 5,875,552 | A | | 3/1999 | Chen | |
| D411,091 | S | | 6/1999 | Halligan | |
| D415,671 | S | | 10/1999 | Halligan | |
| D427,043 | S | | 6/2000 | Cheng | |
| 6,079,106 | A | | 6/2000 | Vallotton | |
| D429,986 | S | | 8/2000 | Cheng | |
| 6,101,722 | A | | 8/2000 | Cheng | |
| 6,101,724 | A | | 8/2000 | Halligan | |
| 6,105,255 | A | | 8/2000 | Cheng | |
| 6,145,202 | A | | 11/2000 | Onion | |
| 6,360,443 | B1 | | 3/2002 | Remus | |
| 6,427,334 | B2 | | 8/2002 | Onion | |
| 6,574,868 | B1 | * | 6/2003 | Overholt | 30/155 |
| 6,438,848 | B1 | | 8/2003 | McHenry et al. | |

* cited by examiner

*Primary Examiner*—Kenneth E. Peterson
*Assistant Examiner*—Omar Flores Sánchez
(74) *Attorney, Agent, or Firm*—Ipsolon LLP

(57) ABSTRACT

A folding tool such as a knife or multitool has a handle defined by opposed side walls with a slot therebetween. An implement such as a blade is pivotally connected to the handle. A spring such as a liner disposed between the implement and one side wall has a longitudinal slot cut therein and opening on the end adjacent the implement attachment to define a spring arm. The slot includes a constricted zone that is preferably substantially V shaped and has an apex aligned with the pivot axis of the implement. A pin on the implement rides in the slot. When the pin is on the rearward side of the apex the spring arm applies pressure to the implement and prevents it from moving into the open position. The implement is thus safely and securely locked into the handle. When the implement is rotated so that the pin is moved onto the forward side of the apex, past a threshold point, the spring arm returns to its resting position, imparting pressure on and energy to the implement pin to thereby provide opening assist for moving the implement into the fully open position. A lock is provided to securely lock the implement in the open position for use.

19 Claims, 4 Drawing Sheets

A
14
22
38
42
44
51
52
53
60
70
72
74
76
78
80
82
84
85
86
87
88
89
90
92

FOLDING TOOL

This application is a continuation of Ser. No. 10/043,480 filed Jan. 10, 2002 now U.S. Pat. No. 6,732,436

FIELD OF THE INVENTION

This invention relates to folding tools such as knives and multitools, and more specifically to a mechanism configured for firmly and safely retaining implements such as knife blades closed in the handle until a user intends the implements to be opened, and also for providing an opening assist for extending the implements into an open position for use.

BACKGROUND

Most folding knives and other folding tools include some kind of a mechanism that holds the blade or working implement safely in the closed position. In the case of knives, the blade is held in the closed position with the sharp cutting edge held safely within the handle. There are many, many known mechanisms for retaining blades in the closed position, and there are obvious reasons why such mechanisms are used. Among other reasons, blade-retaining mechanisms prevent unintended opening of the knife and thus promote safety. Even so, there are other reasons why most commercially available knives include devices that prevent unintended opening of the blade, and those include the need for compliance with applicable laws and regulations relating to knives that may be opened automatically. Nonetheless, safety considerations dictate that it is very important for a folding tool such a knife to include a mechanism that firmly and safely holds the blade in the closed position, and that the mechanism does not fail in any possible use situation.

Automatic opening mechanisms may be incorporated into folding knives and other folding tools, and there are many variations in what automatic opening mechanisms do, and how they function. Likewise, in appropriate circumstances and for appropriate users, there are many advantages to be derived from automatic or semi-automatic opening knives and many situations where automatic knives can be useful. These often include situations where the user has only one hand free. However, even in a knife that includes an automated opening or opening assist mechanism, safety considerations always mandate that the blade stays in the closed position until the user volitionally and intentionally moves the blade into the open position. For example, a mechanism that holds a knife blade closed should never release when the knife is dropped.

There is a need therefore for a mechanism that reliably retains the blade safely in the closed position, even in a knife that includes an automatic opening mechanism, and therefore eliminates the dangers inherently associated with a blade that could be opened either with a flick of the wrist, or inadvertently. There also is a need for mechanisms that safely maintains the blade in the closed position while providing opening assist functionality.

The present invention comprises a safety mechanism that may be incorporated in folding tools of all kinds, including knives and multitools and the like. With reference to a folding knife, the mechanism of the present invention preferably uses a liner spring to bias the blade into the closed position with the blade safely held in the knife body. The mechanism holds the knife blade firmly in this closed position until the user intentionally desires to open the knife. The blade cannot be moved into the open position with even an exceedingly strong "flick of the wrist." Instead, the user must intentionally and volitionally begin rotating the blade from its closed position toward the open position, against the biasing force of the mechanism pushing the blade toward the closed position.

The present invention further may comprise a mechanism for providing opening assist functionality. Once a certain critical or "threshold" point in the rotational movement is passed as the blade is moved from the closed toward the open position, the mechanism of the present invention rotationally drives the blade into the fully open position. This is accomplished by use of a spring mechanism that applies force to the blade, imparting sufficient rotational kinetic energy to the blade that the inertia drives the blade into the fully open position. A locking mechanism locks the blade in the open position.

To close the knife, the locking mechanism is released and the blade is rotated in the opposite direction—from open to closed. Once the blade is again moved past the critical point in the rotational movement, the actuating mechanism drives the blade back in the opposite direction—that is, into the closed position. By varying structural parameters, the amount of force applied to the blade in both the opening and closing direction may be varied and controlled. This can be of use when, for example, the manufacturer desires the closing force to be less than the opening force.

The actuating mechanism is in one preferred embodiment defined by a liner having a longitudinal slot cut therein and having an open end on the forward end of the knife body. The slot follows a specific path that at one point in a preferred embodiment is constricted and defines a top-dead-center point. This point in turn defines a threshold point, and is typically a generally V-shaped section of the slot.

The slotted liner thus defines a spring mechanism and the liner material on one side of the slot is a spring arm that exerts a biasing force on a cam pin extending from the tang of the blade, and which rides in the slot. When the blade is rotated about a blade pivot axis the pin likewise moves through an arcuate path, moving the pin longitudinally in the slot. As the pin moves longitudinally in the slot, the pin causes the spring arm defined by the liner material to lift, thereby exerting a biasing force on the cam pin, and thus on the knife blade. Depending upon which side of the threshold point the pin is on, the biasing force applied to the blade causes the blade to be forced in one of two directions (i.e., either toward the open position or toward the closed position).

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

A preferred embodiment of a folding knife 10 incorporating an actuating apparatus according to the present invention is illustrated in FIGS. 1 through 9. It is to be understood that while the invention is described herein with specific reference to use of the invention in a folding knife, the invention may be incorporated into folding tools of all kinds. The invention is thus not in any way limited to folding knives and instead applies to folding tools having implements that are movable between a closed position in which the implement is housed at least partially in the handle, and an open position in which the implement is extended to a position where it may be used for its intended work.

Figures 1, 2:
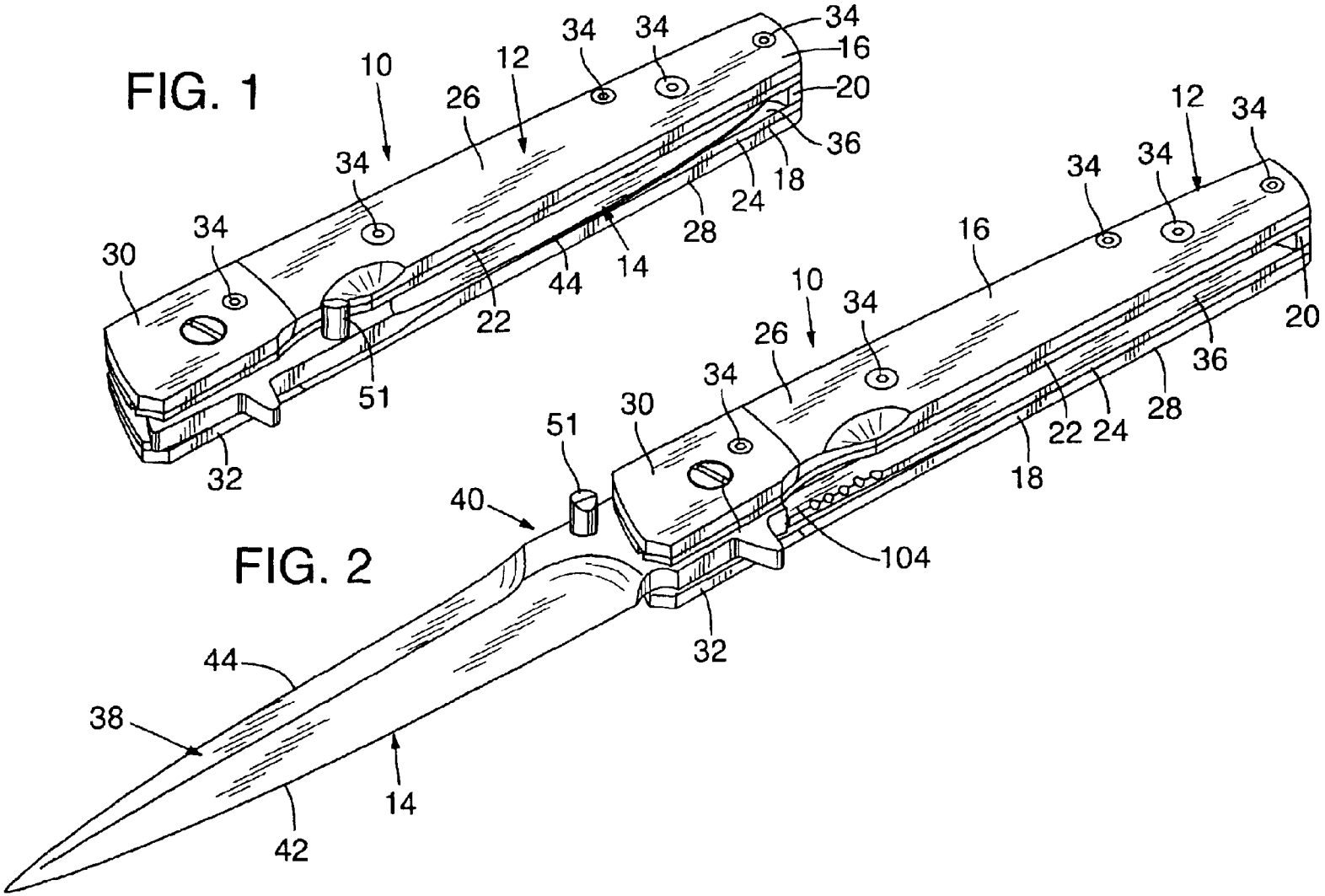
FIG. 1 is a perspective view of a folding knife incorporating a preferred embodiment of an actuating mechanism according to the present invention, and illustrating the knife with the blade folded into the knife handle in the closed position.
FIG. 2 is a perspective view of the folding knife shown in FIG. 1 with the blade moved into the open position.

Referring now to FIGS. 1 and 2, folding knife 10 includes an elongate handle 12, and a blade 14 that is pivotally attached to the handle at one of its opposite ends. FIG. 1 shows the knife 10 with the blade 14 in a closed position in which the blade is received within the handle 12. FIG. 2 illustrates the knife 10 with the blade 14 in an open or use position. The blade 14 of the knife 10 of the present invention is capable of being locked securely in that open position to prevent the inadvertent movement of the blade to its closed position. The blade locking mechanism is described below.

Figure 3:
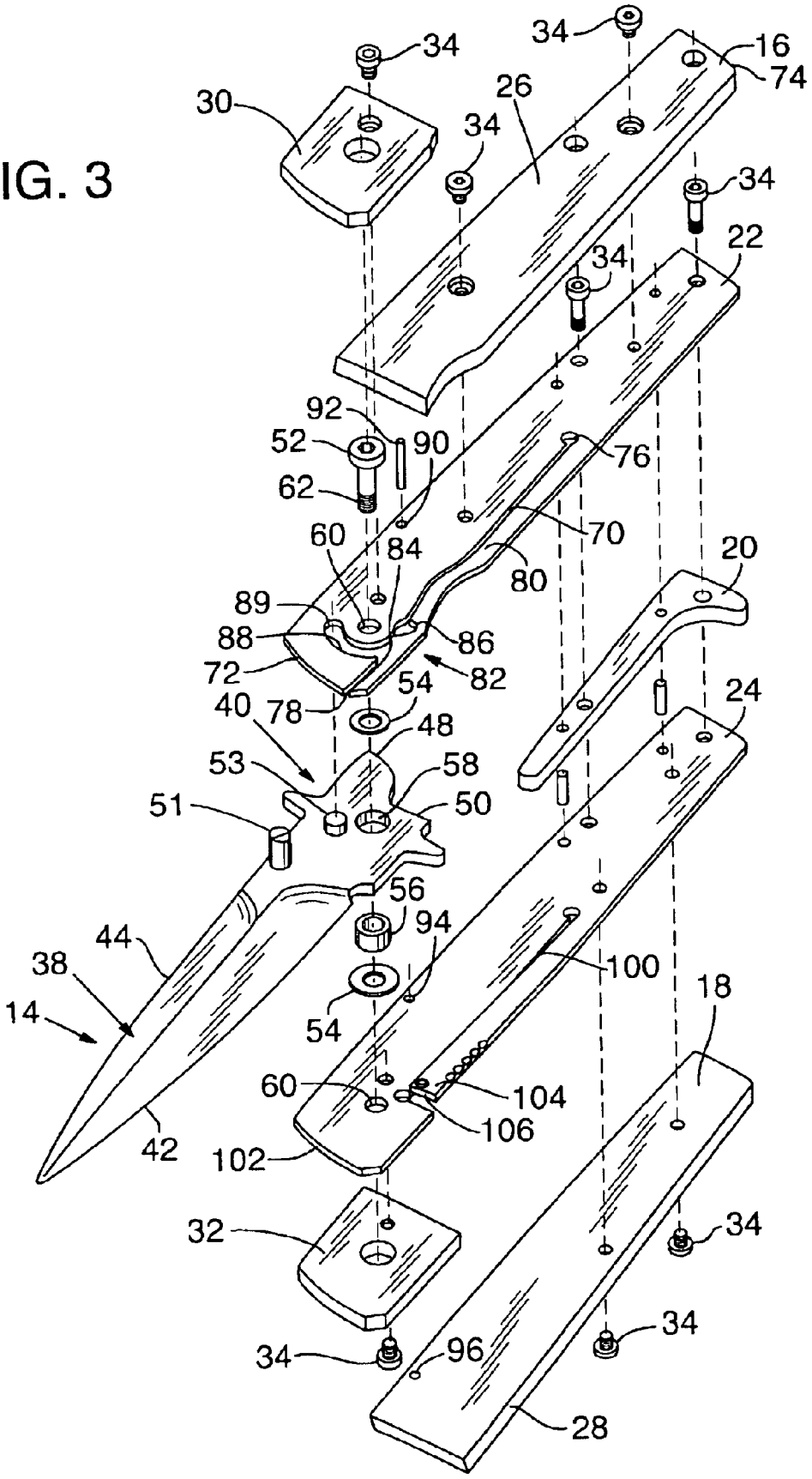
FIG. 3 is a perspective exploded view illustrating the component parts of the knife shown in FIG. 1.

Handle 12 of knife 10 comprises several components, including a pair of oppositely located side wall sections, generally indicated at 16, 18, that are parallel with each other and spaced apart from one another by a spine member 20 which is located between the side wall sections along their upper long edges and which curves around the rearward end of the handle (FIG. 3). A liner member 22 is disposed inwardly alongside side wall section 16. Similarly, the other side wall section 18 has a liner member 24 disposed inwardly alongside the side wall. Side wall sections 16 and 18 may be fabricated in a single piece from any suitable material such as a reinforced hard synthetic plastics material such as MICARTA™, although other suitable materials such as metal, other plastics, wood, etc. can also be used. Further, and as shown in the figures, the side wall sections may be fabricated in multiple pieces. More specifically, each side wall section 16 and 18, respectively, includes a rearward section 26 and 28, respectively, and a forward section 30 and 32, respectively. If the handle 12 is manufactured in this manner the forward sections 30 and 32 are preferably fabricated from a strong metal material, since these sections provide support for the blade pivot pin, as detailed below.

When handle 12 is assembled, the spine section 20 is disposed between the liner members 22 and 24 and extends along the upper edge margins of the liners and side walls 16 and 18. As illustrated in FIGS. 1 and 2, the side wall are aligned with the liner sections and the spine section in the assembled knife 10. Suitable fasteners such as screws 34 are used to hold together the side wall sections 16, 18, the liner members 22 and 24, and the spine section 20.

The liners 22 and 24 are preferably fabricated from resilient steel such as a spring steel or titanium since both of these components utilize and rely upon the resiliency of the material to perform certain functions. Other resilient materials may, however, be used to fabricate these parts.

Similarly, spine 20 is preferably made of steel.

A blade receiving groove 36 is defined between the side walls 16, 18 and their associated liner members 22 and 24, respectively. The blade receiving groove 36 receives the blade 14 when it is moved to its closed position, as shown in FIG. 1.

The blade used with knife 10 may be of any known type. The blade 14 shown in the drawings comprises an elongate working portion 38 and a tang portion 40, which pivotally attaches the blade to the handle 12. Working portion 38 typically includes a sharp edge 42 and a blunt edge 44. Blade 14 is attached to handle 12 such that the blade's working portion 38 extends away from the handle 12 when the blade 14 is in its open position (FIG. 2), and tang portion 40 is located within the blade receiving groove 36 when the blade is in either the open or the closed position. That is, the tang portion 40 is always located between the liners 22 and 24 of handle 12.

More specifically, the working portion 38 of blade 14 is constructed in a well-known manner and is pivotally attached to the handle by the tang portion 40 so that the sharp edge 42 is received within the handle 12 when the blade is in the closed position shown in FIG. 1. With reference to FIG. 3, the tang portion 40 is formed integrally with the blade working portion 38 and has a circular opening 58 that defines a pivot hole for attaching the blade 14 to the handle 12. The peripheral edge of tang portion 40 defines a first shoulder 48 that defines a blade stop surface, and a second shoulder 50 that defines a blade locking surface. The first and second shoulders 48 and 50 are generally perpendicular to the longitudinal axis defined by the handle 12 and blade 14 when the blade is in the open position. A thumb lug 51 is attached to and extends outwardly from blade 14 near the interface between blade working portion 38 and tang portion 40. The thumb lug, if included, may extend from either side of blade 38, or both. A cam pin 53 is attached to and extends outwardly from tang portion 40 of blade 14 adjacent opening 58. The pin may be attached to the blade in any appropriate manner, including threaded openings and the like. Cam pin 53 is positioned on the side of tang portion 40 that lies adjacent liner member 22, and as shown in FIGS. 1 and 2, is at all times concealed between side walls 16 and 18 in the assembled knife 10. As detailed more thoroughly below, cam pin 53 rides in a slot formed in liner 22. It should be noted, however, that the pin does not extend through the slot and does not make contact with adjacent side wall 16.

As best shown in FIG. 3, an annular shaft 52, preferably fabricated from hard steel attaches blade 14 to handle 12 with one of a pair of annular shims 54 (each labeled with number 54) placed on each side, between the liner members 22 and 24 and the blade 14. The shaft 52 is fitted into an annular sleeve 56 that is press-fitted into the opening 58 formed in tang portion 44 of blade 14. Shaft 52 fits rotatably but snugly through circular pivot openings 60 defined in the liner members 22 and 24, respectively (the pivot opening in each liner is labeled with reference number 60), so that shaft 52 defines a pivot axis for the blade extending transversely with respect to side walls 16 and 18. The annular shims 54 are received over respective ends of the shaft 52 as indicated in FIG. 3. Shaft 52 has a threaded end 62 for receiving a screw fastener (not shown) attached to the threaded end, and which helps to keep knife 10 assembled.

Figures 4, 5, 6:
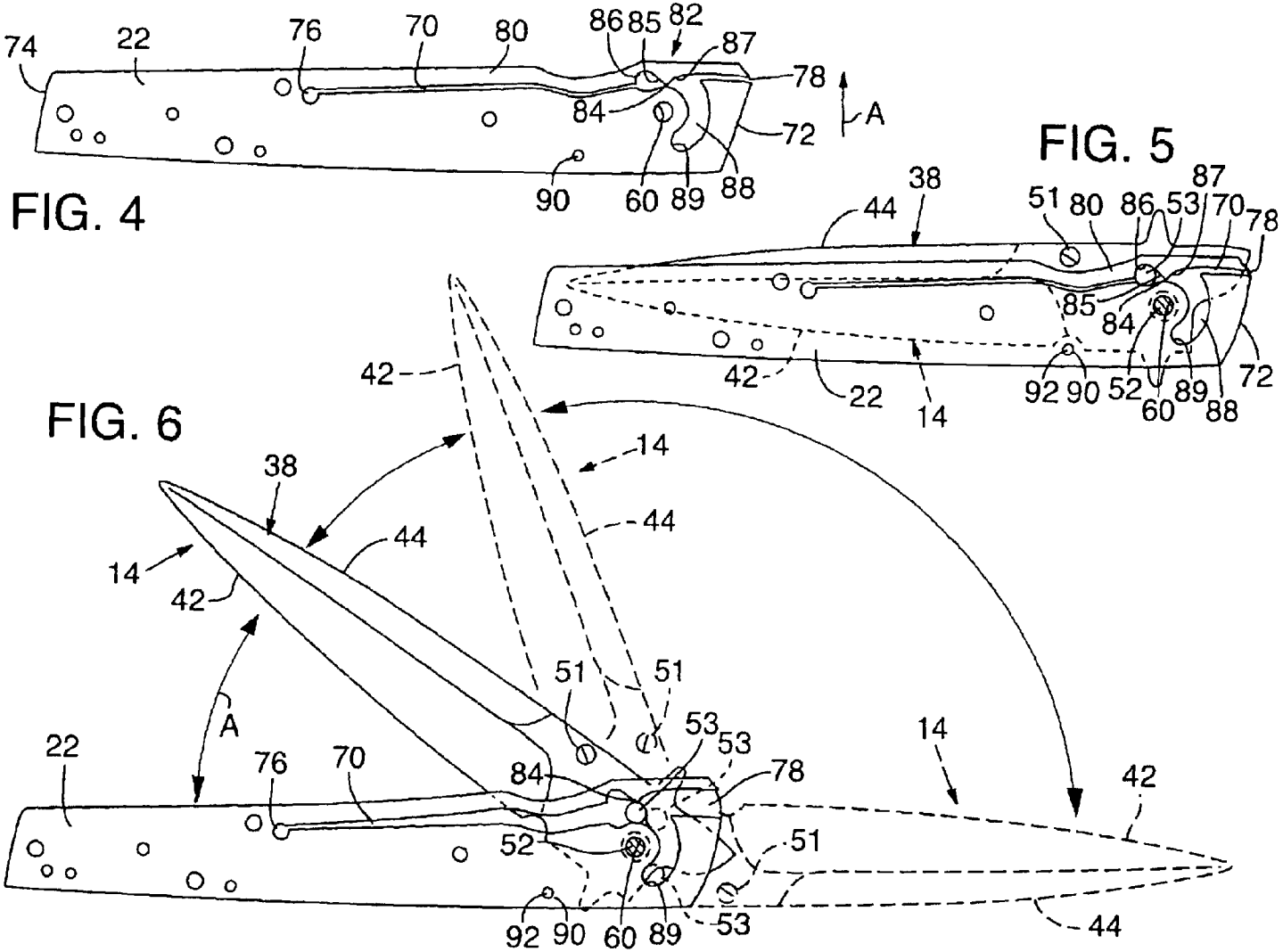
FIG. 4 is a side elevation view of one liner member according to the present invention as used in a knife as shown in FIGS. 1 through 3.
FIG. 5 is a side view of the knife shown in FIG. 1 with the handle side wall on the near side removed to expose the liner, and illustrating the knife blade partially in phantom lines in the closed position.
FIG. 6 is a side view as in FIG. 5 and illustrating the blade in a sequence of positions between the closed position of FIG. 5 and the fully open position.

The specific construction of liner member 22 will now be detailed with reference to FIGS. 3 and 4. An elongate spring slot 70 is cut through liner member 22. Spring slot 70 begins at the forward end 72 of member 22 and extends longitudinally along member 22 toward the rearward or butt end 74 of the member until the slot terminates at a closed slot end 76. In the embodiment illustrated, the slot 70 at closed slot end 76 is slightly enlarged. The end of spring slot 70 opens through the forward end of member 22 at an open slot end 78. Spring slot 70 thus defines a spring arm 80. Spring slot 70 and spring arm 80 define a curved path that in the preferred embodiment defines a V shaped path at an area along the slot generally designated with reference number 82. The apex of the V of the V shaped path, defined by spring arm 80, is designated with reference number 84. Apex 84 is aligned with and points directly at the central axis through pivot opening 58 (through which shaft 52 extends). The width of spring slot 70 narrows or is constricted at apex 84, as illustrated in FIGS. 3 and 4. Moving rearward in slot 70 toward butt end 74, and just rearward of the V shaped portion of path 82 is an enlarged area in slot 70 that defines a cam pin seat 86. The leg of the "V" defined in spring arm 80 that lies on the rearward side of apex 84 is referred to as the rearward leg 85. The leg of the "V" defined in spring arm 80 that lies on the forward side of apex 84 is referred to as the forward leg 87. Moving in the opposite direction, just forward of V shaped path 82 and forward leg 85 is a cam pin travel channel 88 that diverges off of slot 70 and which curves generally arcuately and coaxially around pivot opening 58. Cam pin travel channel 88 terminates at a cam pin seat 89. A blade stop pin hole 90 receives a blade stop pin 92, which extends in the assembled knife through hole 90 in liner 22, an aligned blade stop pin hole 94 in liner 24 (see FIG. 3), and has its opposite ends anchored in openings 96 formed in side walls 16 and 18 (only one of which is shown in FIG. 3).

Because spring slot 70 is open at open slot end 78, and because liner member 22 is fabricated of a resilient material, spring arm 80 may be moved in such a manner as to widen the width of slot 70. Stated in another way, spring arm 80 may be moved away from the remaining material in liner 22 by "pivoting" the spring arm at closed slot end 76. It will be appreciated that spring arm 80 is moved in the same plane as the plane defined by the liner member, and therefore that moving spring arm 80 in this manner requires some force. That is, when spring arm 80 is moved out of the resting position shown in FIGS. 3 and 4 and in the direction indicated by arrow A in FIG. 4, the spring arm exerts a significant biasing force in the opposite direction.

The specific construction of liner member 24 will now be briefly described with reference to FIG. 3. Liner member 24 includes a slot 100 that terminates near the forward end 102 of the liner to define a tab 104 having a forward end 106. Slot 100 and tab 104 of liner member 24 define a standard liner locking mechanism that is well known in the art. As such, its construction is only briefly mentioned here, as those of ordinary skill in the art are well suited to understand its principles. Thus, liner member 24 is formed such that tab 104 in a resting position is biased inwardly and offset from the remainder of the liner material—that is, the tab in a resting state is biased toward the blade receiving groove 36 and in the direction that is generally transverse to the plane defined by the liner member.

The manner of operation of the mechanism defined by liner member 22 will now be detailed with reference to FIGS. 5 through 8.

Liner 22 of knife 10 is detailed in FIG. 5 with blade 14 included, and the blade in the closed position. In this position, the knife is received in blade receiving groove 36 with the sharp edge 42 safely stowed in the slot so that it is not exposed. When knife 10 is assembled, cam pin 53 engages and rides in spring slot 70. When the blade is in the closed position, cam pin 53 rests in cam pin seat 86 of spring slot 70 with the cam pin abutting rearward leg 85. Cam pin 53 and cam pin seat 86 are cooperatively sized so that in the closed position, the cam pin rests against the rearward leg 85 with the spring arm 80 exerting pressure on the cam pin. Thus, in the position shown in FIG. 5, spring arm 80 is near its resting position yet still making contact with cam pin 53, and thus exerts biasing pressure on blade 14 through cam pin 53 as it abuts the rearward leg 85. This biasing pressure holds the blade firmly in the closed position and prevents it from moving into the open position until the user desires that action.

Sequences of blade positions that illustrate the manner by which the blade is moved into the open position are shown in FIG. 6. As blade 14 is first moved from the closed position toward the open position (for example, by the operator pushing on thumb lug 51 in the direction of arrow A in FIG. 6), the blade rotates about shaft 52, causing cam pin 53 to likewise rotate in an arcuate path. The cam pin rides in spring slot 70. As the cam pin moves forwardly in spring slot 70 (in the direction toward forward end 72), it rides up the rearward leg 85 toward the apex 84 of the V, thereby lifting spring arm 80. As noted above and as shown in FIG. 4, the width of spring slot 70 narrows moving in the direction from cam pin stop 86 toward apex 84, and at apex 84 the width of the slot is less than the diameter of cam pin 53. As a result, as the blade is rotated in the clockwise direction about the axis defined by shaft 52 and into the position in FIG. 6 where the blade is in about the 10 o'clock position, cam pin 53 has traveled in slot 70 to the point where the center of the cam pin is approximately aligned with apex 84. Stated in another way, the point of the V is directed approximately toward the center of the cam pin. In moving the blade in this direction, cam pin 53 must be forced against rearward leg 85 and the biasing force supplied by spring arm 80. It will be appreciated that a significant amount of force must be applied to blade 14 to move it into this 10 o'clock position, since the resilient biasing force of spring arm 80 is acting against cam pin 53 to move the blade back into the closed position.

In the 10 o'clock position, spring arm 80 has been lifted to its maximum extent by cam pin 53 moving through slot 70. The apex 84 thus represents a top-dead-center position for cam pin 53 as it travels through slot 70. With reference to FIG. 6, it may be seen that when blade 14 is about in the 10 o'clock position, the opening width of slot 70 at forward end 78 is at a maximum. Furthermore, at the top-dead-center position just described, the spring force applied against cam pin 53 by spring arm 80 is at a maximum.

As blade 14 is moved further in the clockwise direction, the cam pin 53 continues to move forwardly in spring slot 70. At the point where the center point of cam pin 53 moves through an arcuate path and past the top-dead-center point defined at apex 84, the biasing force applied against the cam pin by spring arm 80 causes the cam pin to ride down the forward leg 87 of the V. Once the cam pin is past the top-dead-center point, the spring force provided by spring arm 80, which is moving quickly into its resting position, biases or drives blade 14 quickly in the clockwise direction.

This spring force acting on the cam pin imparts rotational kinetic energy to the blade, and any and all pressure applied by the user to thumb lug 51 may be released once the cam pin passes the top-dead-center point, and the blade is automatically driven into the open position under the spring force of the closing spring arm working on cam pin 53. Thus, as spring arm 80 snaps back to its resting position, cam pin 53 quickly rides down the forward leg 87 of slot 70 as the spring arm moves to its resting position. Once the blade passes through approximately the 11 o'clock position, the cam pin 53 is no longer in contact with the spring arm and the blade is rotating freely toward the open position. The spring arm imparts sufficient energy to the blade that the inertia of the blade carries it into the open position.

There is therefore a threshold point in the pivotal rotation of blade 14 from the closed to the open position beyond which the spring arm 80 supplies all of the energy necessary to move the blade into the fully open (and locked) position. In the preferred embodiment, the threshold position is the point in the rotation of the blade where the cam pin moves far enough relative to the spring arm that the spring arm begins to close on its own, thereby forcibly driving the blade into the fully open position in the manner described.

With reference to FIG. 6, when the blade is at the 11 o'clock position (shown in dashed lines) cam pin 53 has moved past the apex 84 (i.e., past the top-dead-center point and threshold point) and the spring arm 80 is closing—that is, moving back to its resting position in the direction of arrow A. Cam pin 53 rides in slot 70 along the forward leg 87 of the V, as noted, and the inertia of the blade freely and quickly rotates the blade to the fully open position (shown in dashed lines with the blade in about the 3 o'clock position). As illustrated, cam pin 53 rides in cam pin travel channel 88 as the blade rotates from about the 12 o'clock position until the blade is in the fully open position.

Figure 7:
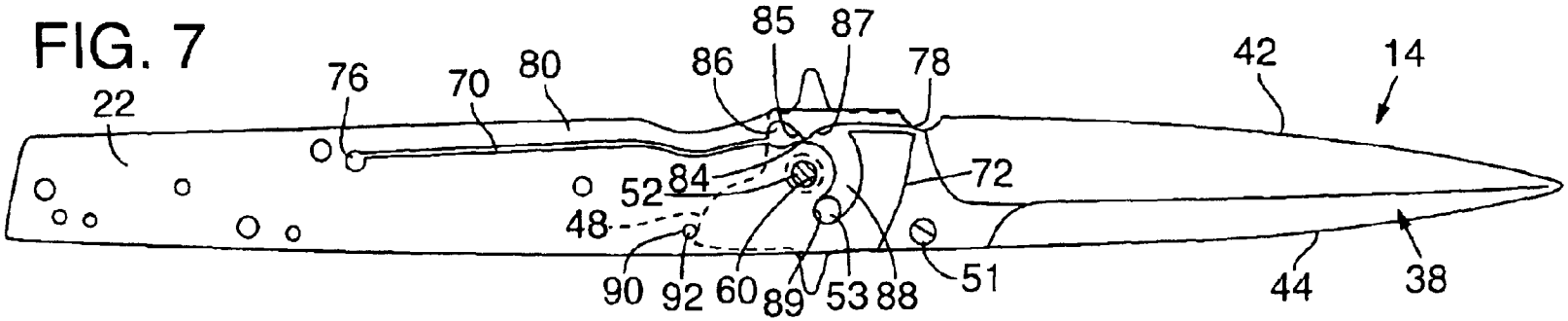
FIG. 7 is a side view of the knife shown in FIG. 6 with the blade in the fully open position.

Referring now to FIG. 7 it may be seen that with blade 14 in the fully opened position, spring arm 80 has moved back into the resting position. The forward rotation of blade 14 is stopped when shoulder 48 of tang portion 40 abuts blade stop pin 92 and cam pin 53 rests in cam pin seat 89. The combination of the stop pin and the cam pin seat provide a strong stop mechanism for preventing the blade from further movement in the clockwise direction.

Figure 8:
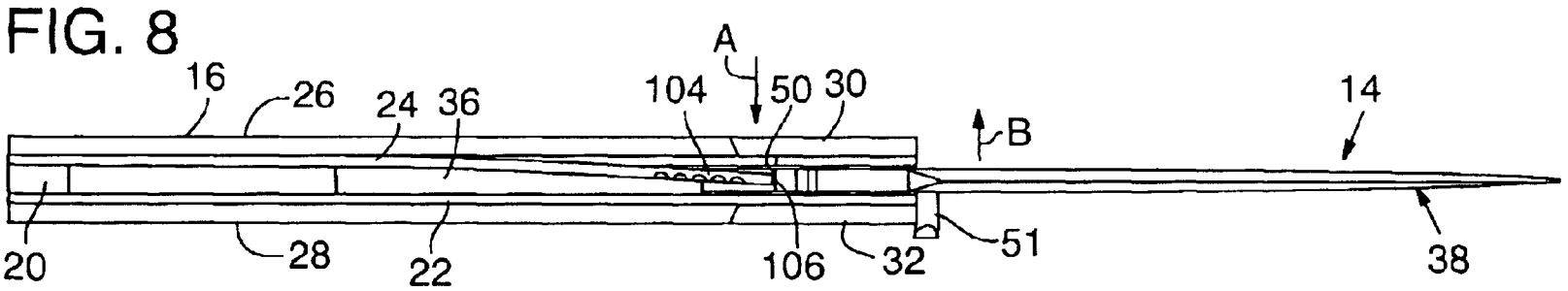
FIG. 8 is a bottom view of the knife shown in FIG. 7, with the handle side wall included, and illustrating the blade locking mechanism.
Figure 9:
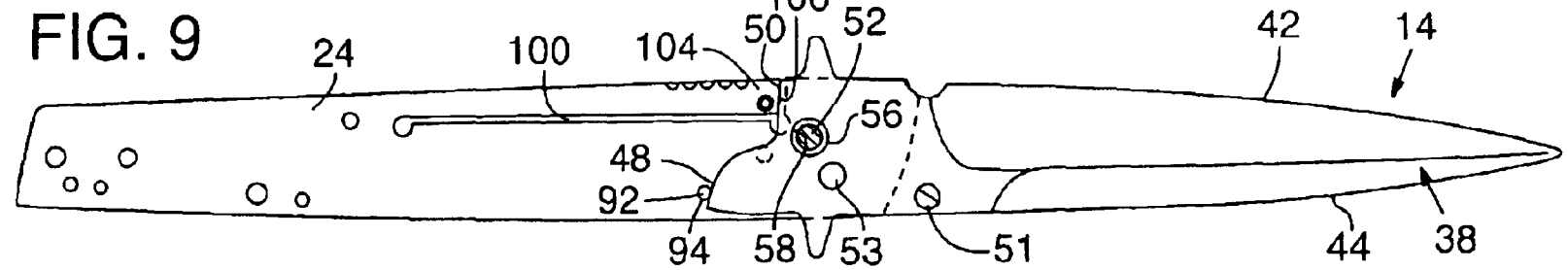
FIG. 9 is a side view of the knife shown in FIG. 8, with the nearside side wall removed to illustrate the implement locking mechanism.

Knife 10 includes as noted a liner locking mechanism that is incorporated into liner 24 and which is defined by tab 104. As shown in FIG. 8, when blade 14 is in the fully open or extended position, tab 104 moves inwardly toward the blade (in the direction of arrow A) until the forward end 106 of the tab engages shoulder 50 of tang portion 40. As noted above, the liner locking mechanism described herein is a standard mechanism. In FIG. 9 it may be seen that forward end 106 of tab 104 engages the shoulder 50, and that with the blade in the open position, stop pin 92 abuts shoulder 48. It will be understood by those skilled in the art that in addition to the liner locking mechanism just described, numerous other known mechanisms may be used, including for example lock-back structures and locking pins that extend transverse to the blade.

Blade 14 is moved from the fully open position to the closed position in essentially the reverse order of the opening procedure described above. First, the liner locking mechanism that locks blade 14 in the extended position is released by pushing tab 104 outwardly, that is, in the direction of arrow B, until the forward end 106 of tab 104 disengages from shoulder 50 of tang portion 40. Once the tab clears shoulder 50, the blade may be freely rotated about the pivot axis defined by shaft 52 toward the closed position—counterclockwise in FIGS. 6 and 7. The blade freely rotates in the counterclockwise with cam pin 53 moving through cam pin channel 88 until the cam pin begins to ride up the forward leg 87 of the V. Once the cam pin touches the forward leg 87, force must be applied to the blade to continue rotation of the blade against the biasing force applied by spring arm 80. As described above, cam pin 53 rides through slot 70, this time in the opposite direction, lifting spring arm 80 until the cam pin moves just past the top-dead-center point of apex 84. Once cam pin 53 passes this threshold point, the closing force supplied by spring arm 80 moving back to its resting position drives blade 14 into the fully closed position. Thus, cam pin 80 rides down rearward leg 85 as spring arm 80 closes until cam pin 53 rests in cam pin seat 86, which prevents the blade from moving any further in the closing direction.

There are several structural attributes of liner 22 that may be varied in order to change the operating properties of the actuating mechanism defined by the liner. First and most importantly, the force applied to cam pin 53 when the blade is in the closed position must in all instances be sufficient to retain the blade fully closed against all opening force except a force that intentionally opens the blade. Thus, liner 22 must be designed so that, for example, the blade cannot be opened with a flick of the wrist or similar motions, no matter how hard the motion is. The force delivered by spring arm 80 may be varied in numerous ways. For example, the characteristics of the material selected for fabricating liner 22 will have a directed effect on the amount of spring force. Moreover, the materials used to fabricate both cam pin 53 and liner 22 are selected so that there is minimal friction between the two when they abut one another. The abutting surfaces may be treated, for instance with polishing or with surface coatings, to further minimize friction between the two and to thereby increase the rotational speed of the blade after the cam pin passes the top-dead-center point (moving rotationally in either direction).

Likewise, the thickness of liner 22 and the length of the slot 70 directly impact the opening and closing spring force of the spring arm. Thus, when a thicker material is selected the lifting force required to move spring arm 80 out of the resting position is greater. When the length of slot 72 is shortened, more lifting force is necessary. And the size of the enlargement at the closed end of the slot will vary the amount of force required to move the spring arm. The angle of the forward and rearward legs 87 and 85, respectively, with respect to one another and the width of slot 70 at apex 84 will impact the spring force. Further, during manufacture of liner 22, once slot 70 is cut into the liner the spring arm 80 may be pre-compressed by forcing the spring arm toward the body of the liner and deforming slightly the spring arm. All of these factors may be varied to control the opening and closing force applied by spring arm 80.

With respect to the angles or "slopes" of the forward and rearward legs of the V, it will be appreciated that the steeper the slope, the more quickly the blade will rotate. That is, if forward leg 87 is made relatively more steep than shown in FIG. 4, blade 14 will rotate relatively more quickly in the clockwise direction once the cam pin moves past the top-dead-center point defined by apex 84. A relatively less steep slope produces the opposite effect, and the same applies to the steepness of rearward slope 85. Of course, the steepness of the slope on one side of apex 84 may be different from the slope on the opposite side, thereby making the closing characteristics of the blade different from the opening characteristics. Further, the slot may be cut in the liner so that the slot follows a curved path rather than a V shaped path. In this case the "apex" would be more rounded and the effect on the blade opening would be to tend to slow the speed at which the blade is biased into either the open or closed position. Further, the forward and rearward legs of the V may be either straight or curved. In the preferred embodiment the legs are slightly curved to provide a more efficient transfer of energy from the spring arm to the blade. Finally, the slot 70 may be linear rather than curved, and the apex and/or constriction may be eliminated.

The position at which cam pin 53 is located relative to the axis of pivotal rotation of blade 14 also directly impacts the amount of "lift" of the spring arm, and thus the amount of force applied by the spring. Thus, the further that the cam pin is located from the axis of rotation, the greater the arc that the pin travels through as the blade is rotated. As the arc of travel increases (that is, as the cam pin is moved further away from the axis), the further the pin will cause the spring arm to lift, and the more force that is applied to the blade.

It will be appreciated that the shape of the spring slot may be varied widely without affecting the operation of the actuating mechanism of the present invention. A major driving force for moving the blade from the closed position to the open position is provided by the pressure applied by the user to the thumb lug. With a slot that defines a V-shaped apex as described above, the closing force of the spring arm does drive the blade significantly once the threshold point is passed. However, even where the contact surface in the slot between the cam pin and the spring arm is straight, the basic actuating mechanism functions adequately.

Finally, the position of the cam pin relative to the pivot axis may be changed so that the pin is located on the opposite side of the pivot axis as illustrated in FIGS. 1 through 8. In this case the same action would be achieved, but the structural integrity of the liner would be compromised somewhat since the cam pin travel channel would be cut into the liner rearward of the pivot opening, and the blade stop pin would need to be repositioned accordingly.

Alternate Embodiments

As one alternative to the slotted liner actuating mechanism described above, the same functional characteristics may be accomplished by utilizing a wire strung under tension from the forward portion of the handle to the rearward part of the handle and such that a cam pin extending from the tang of the blade lies in an abutting relationship to the wire when the knife blade is in the closed position. The wire so strung does not engage the tang of the blade but instead exerts pressure on the blade through a cam pin. Those skilled in the art will appreciate that the tensioned wire acts as a spring for holding the blade in the closed position, but also for providing opening assist for moving the blade into the open position once a top-dead-center or threshold point is passed in the rotation of the blade. As the knife blade rotates into the open position from closed, so too will the pin rotate in an arcuate path. As the pin rotates into the wire, it causes the wire to deflect, increasing the tension on the wire and causing the wire to function much like a spring by exerting pressure on the pin. When the blade rotation passes the threshold point the biasing pressure on the pin will drive the blade into the fully open position.

In another modification, the handle side walls 16 and 18 may be omitted altogether, in which case the liners 22 and 24 become the outer side walls of the knife body.

In another embodiment, the liner slot may be used solely as a detent mechanism to keep the blade safely and securely in the closed position. In this respect, the portion of the spring arm forward of apex 84 may be omitted, which of course eliminates the opening assist feature.

Finally, in yet another embodiment the spine that separates the two body side walls defines the spring mechanism that forms the actuator. In this case (not shown in the drawings) a standard "slip joint" is modified so that in addition to holding the blade in the closed position, it provides an opening assist.

While the present invention has been described in terms of a preferred embodiment, it will be appreciated by one of ordinary skill that the spirit and scope of the invention is not limited to those embodiments, but extend to the various modifications and equivalents as defined in the appended claims.

What is claimed is:

1. In a tool having an elongate body having a forward end and a rearward end, the body formed by two opposed side walls forming a channel therebetween, and an implement pivotally attached to the body at the forward end and the implement is movable from a first position in which it is at least partially received in the channel and a second position in which the implement is partially rotated out of the channel, the improvement comprising:

a liner disposed between the implement and one of said side walls, the liner having an elongate slot formed therein for receiving a pin extending from said implement and said slot having an open end and a closed end, said slot defining a path having a constricted portion at an apex along said path, said pin having a diameter greater than the width of the slot at the constricted portion, and said implement pivotal in said body such that said pin moves in said slot as said implement is pivoted.

2. The tool of claim 1 wherein said slot defines a spring arm that exerts pressure on said pin as said pin moves in said slot.

3. The tool of claim 1 including a second liner disposed between said implement and the other of said side walls, said second liner defining a tab that engages a shoulder on said implement when said implement is in said open position.

4. The tool of claim 3 wherein the pivotal attachment of said implement to said body defines a pivot axis and said slot defines a curved path and said apex is substantially aligned with said pivot axis.

5. The tool of claim 1 wherein said slot defines a rearward pin seat rearward of said apex in which said pin rests when said implement is in the closed position.

6. The tool of claim 5 including an arcuate pin channel communicating with said slot forward of said apex, said pin channel terminating in a forward pin seat in which said pin resets when said implement is in the open position.

7. The tool of claim 5 wherein when said implement is in the closed position the pin rests in the rearward pin seat and the spring arm exerts pressure on said pin to retain said implement in said closed position.

8. The tool of claim 7 wherein when said implement is moved from said closed to said open position, said pin moves from said rearward pin seat toward said apex, and wherein when said pin moves past said apex said spring arm exerts pressure on said pin to drive said implement into said open position.

9. A folding tool, comprising:

a handle having first and second opposed side walls held in a spaced-apart arrangement to define a slot therebetween;

an implement having a working portion and a tang portion pivotally attached to the handle, said implement movable about a pivot axis between a closed position and an open position, said implement having a pin extending therefrom;

implement opening assist means comprising a liner having a slot for receiving the pin, the slot having an open end and a closed end and a constriction defined by an apex, and said liner for exerting pressure on said pin to assist moving the implement to the open position.

10. The folding tool of claim 9 wherein the opening assist means further comprises said apex aligned with said pivot axis, said slot defining a spring arm.

11. The folding tool of claim 10 wherein the pin has a diameter and the width of the slot at the constriction is less than the pin diameter.

12. The folding tool of claim 11 wherein the apex is defined by a V-shaped section of said spring arm and wherein when said implement is moved from said closed to said open position, said pin moves from a position rearward of said apex and past said apex, and wherein when said pin moves past said apex said spring arm exerts pressure on said pin to drive said implement into said open position.

13. The folding tool of claim 12 wherein said slot further defines a rearward pin seat rearward of said apex in which said pin rests when said implement is in the closed position.

14. The folding tool of claim 13 including an arcuate pin channel in communication with said slot forward of said apex, said arcuate pin channel terminating in a forward pin seat in which said pin resets when said implement is in the open position.

15. A folding tool, comprising:

a handle having first and second opposed side walls held in a spaced-apart arrangement to define a slot therebetween;

an implement having a working portion and a tang portion pivotally attached to the handle, said implement movable about a pivot axis between a closed position and an open position, said implement having a pin extending therefrom, said pin having a pin diameter;

a liner having a slot formed therein for receiving the pin, the slot having an open end and a closed end and constricted portion aligned with said pivot axis, the constricted portion of said slot having a width that is less than the pin diameter.

16. The folding tool according to claim 15 including lock means for locking said implement in said open position.

17. The folding tool according to claim 15 wherein said slot defines a spring arm that exerts pressure on said pin when said implement is moved about said pivot axis.

18. The folding tool according to claim 17 wherein said constricted portion is defined by an apex on said spring arm.

19. The folding tool according to claim 18 wherein when said implement is moved from the closed position toward the open position and said pin moves past said apex, said spring arm urges said implement into the open position.

* * * * *